United States Patent [19]

Beer et al.

[11] Patent Number: 4,749,293

[45] Date of Patent: Jun. 7, 1988

[54] RIBBON CASSETTE FOR PRINTERS

[76] Inventors: Eric C. Beer, 20 Gordon Walk, Yateley, Camberley, Surrey; Martin Crisp, 3 Abbey Close, Harmans Water, Bracknell, Berkshire, RG12 3NX, both of Great Britain

[21] Appl. No.: 98,746

[22] Filed: Sep. 16, 1987

Related U.S. Application Data

[63] Continuation of Ser. No. 927,855, Nov. 6, 1986, abandoned.

[30] Foreign Application Priority Data

Nov. 8, 1986 [GB] United Kingdom ..... 8527594

[51] Int. Cl.[4] ..... B41J 33/10

[52] U.S. Cl. ..... 400/196.1; 400/207

[58] Field of Search ..... 400/207, 208, 208.1, 400/196.1

[56] References Cited

U.S. PATENT DOCUMENTS

| | | | |
|---|---|---|---|
| 3,814,231 | 6/1974 | Cappotto | 197/168 |
| 3,877,561 | 4/1975 | Guerrini | 197/151 |
| 4,270,867 | 6/1981 | Haftmann | 400/207 |

*Primary Examiner*—Edgar S. Burr
*Assistant Examiner*—James A. Lisehora
*Attorney, Agent, or Firm*—Lee, Smith & Zickert

[57] ABSTRACT

A cassette for an inked ribbon has a ribbon storage region, in which the ribbon is stored in tightly packed random folds, between two parallel walls spaced apart by a distance slightly in excess of the width of the ribbon. The storage region is bounded by ridges projecting from one or both walls to retain the ribbon within the storage region. This has the advantage compared with side walls for the storage region of lower frictional constraint on the ribbon thereby allowing the ribbon to be more tightly packed in the storage region.

7 Claims, 1 Drawing Sheet

RIBBON CASSETTE FOR PRINTERS

This application is a continuation of application Ser. No. 927,855, filed Nov. 6, 1986, now abandoned.

BACKGROUND OF THE INVENTION

This invention relates to cassettes for containing an inked ribbon for use in printing mechanisms such as are used for printing the data output of computers for example.

One known form of ribbon cassette consists of a housing containing a quantity of inked ribbon held in closely packed loops with guides extending from the housing for guiding the ribbon to and from a printing position in which it passes between a printing element and a paper web or sheet on which printing is to be effected. The ribbon is in the form of an endless loop and is pulled from the housing by engagement between a feed roll-/gear and an idler roll/gear. The ribbon emerging from the rolls is then fed back into the housing. The ribbon may be fed past the printing position a number of times before the ink available from the ribbon is insufficient to effect a clear print impression on the paper. When the ribbon is no longer useful, the cassette must be removed from the printing mechanism and replaced by a new cassette containing a ribbon fully charged with ink. Whenever the cassette needs to be replaced the printing mechanism has to be stopped to enable the old cassette to be removed and a new cassette to be fitted. Hence it is desirable that the cassette should contain the largest practicable quantity of ribbon in the housing so that the cassettes do not require to be replaced too frequently. However there are practical limits on the overall size of cassette which can be accommodated on a printing mechanism. Furthermore friction between the tightly packed folds of ribbon and the walls of the housing results in the need to restrict the total length of ribbon contained in the cassette housing in order to ensure that the force required to draw the ribbon from the housing is not so large that the ribbon could be subjected to fatal damage, stretching or slipping in the drive roll/gear.

SUMMARY OF THE INVENTION

According to the invention a cassette for housing an inked ribbon includes first and second walls spaced apart by a distance slightly in excess of the width of the ribbon to be contained in the cassette; a ribbon storage region extending between said walls; an entry for feeding ribbon into said ribbon storage region; an exit for withdrawing ribbon from the ribbon storage region; and means defining a boundary to said ribbon storage region extending between said entry and said exit, said means being effective to reduce the space between said first and second walls along the boundary to retain the ribbon within said storage region.

Preferably said means defining said boundary of said storage region comprises a ridge on said first wall extending along the boundary and projecting from said first wall towards said second wall. A similar ridge may be provided on the second wall.

The ridge or ridges may extend between the ribbon storage region and the exit to provide a restraint on withdrawal of the ribbon from the housing.

BRIEF DESCRIPTION OF THE DRAWINGS

An embodiment of the invention will now be described by way of example with reference to the drawings in which.

DESCRIPTION OF THE PREFERRED EMBODIMENT

Figure 1:
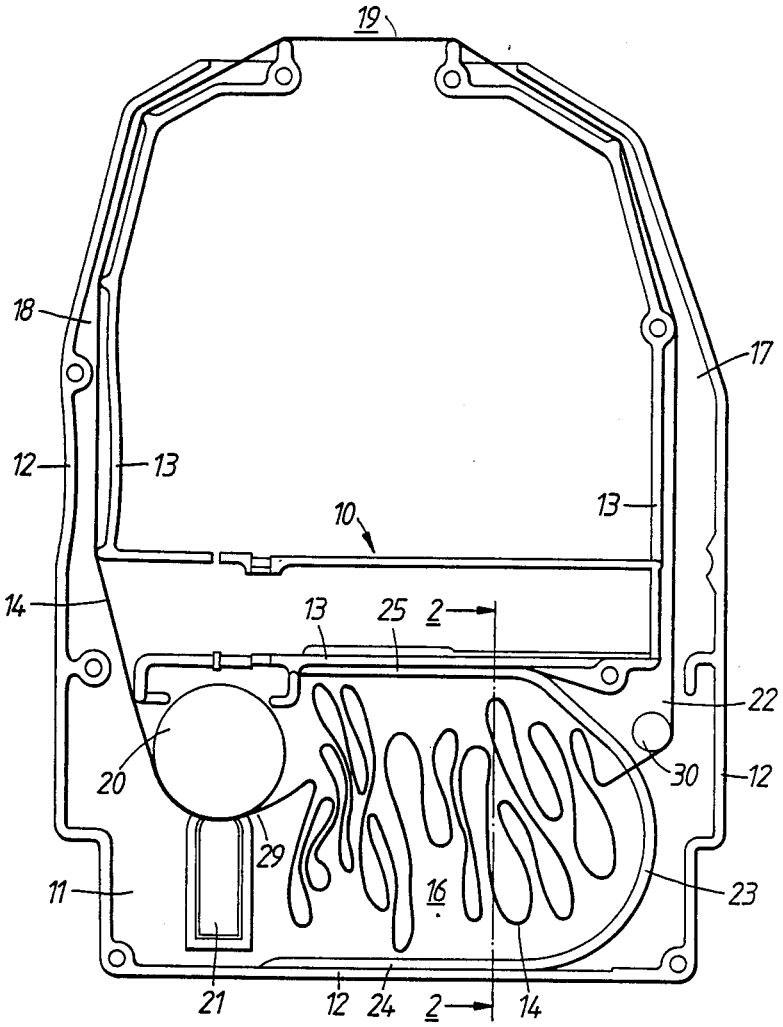
FIG. 1 is a plan view of a ribbon cassette with its cover removed.
Figure 2:
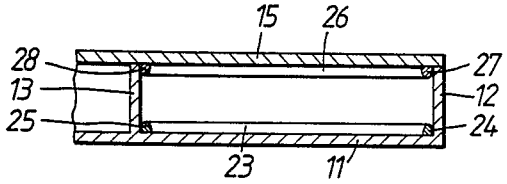
FIG. 2 is a section through the cassette on the line 2—2 of FIG. 1 with the cover in position

Referring to the drawings, a cassette body 10 comprises a generally planar wall 11 from which an outer wall 12 and inner walls 13 extend to define passageways for the feeding of an inked ribbon 14 and to space a cover 15 from the wall 11 by a distance slightly in excess of the width of the ribbon 14. The cassette body 10 has a ribbon storage region 16 and ribbon guide arms 17,18. The inner and outer walls 13,12 on the guide arms define passageways for the ribbon from the ribbon storage area 16 to a printing position 19 between the free ends of the arms 17,18 and thence back to the storage area 16. A drive roll/gear 20 is rotatably supported in the housing adjacent one end of the storage area 16 and an elongate aperture 21 is formed in the wall 11 adjacent the drive roll 20. The elongate aperture 21 permits the entry of a pressure roll/gear (not shown) of the printer mechanism into the housing for cooperation with the drive roll 20. In use on a printer mechanism, the ribbon 14 is engaged between the drive roll/gear 20 and the pressure roll/gear. Rotation of the drive roll 20 by drive means on the printer mechanism engaging the hub of the drive roll causes the ribbon to be drawn from the ribbon storage area in the housing around exit roller 30, along the arm 17, across the gap between the free ends of the arms 17,18 and back along the arm 18 to the drive roll. When the ribbon emerges from between the drive and pressure rolls at 29 it enters and is pushed into the storage area and is stored therein as a mass of tightly packed random folds. In order to restrain this mass of folded ribbon from jamming the exit 22 of the housing a dam or weir 23 extends across the exit. This weir reduces the space between the wall 11 and the cover 13 to a distance slightly less than the width of the ribbon. As the ribbon is drawn by the drive and pressure rolls, it is peeled away from the mass of folds over the restriction presented by the weir 23.

Usually side walls have been provided to the housing to define the ribbon storage area. However it has been found that the friction between the tightly packed mass of folds of ribbon and the side walls results in the necessity of applying such a large force to draw the ribbon from the storage area that the ribbon may be broken, stretched or slip in the drive roll/gear. In order to overcome this difficulty, the boundaries of the ribbon storage area which extend, in the general direction of ribbon flow through the storage area, between the entry adjacent this drive and pressure rolls and the exit in the housing is defined substantially entirely by extensions 24,25 of the weir along the sides of the storage area. The weir 23 and the extensions 24,25 consist of a ridge formed in the wall 11 such that the distance between the wall 11 and the cover 13 is reduced to less than the width of the ribbon. A further weir 26 with extension 27,28 corresponding to the formation of the weir 23 and extensions is provided on the cover 15. Due to the folding of the ribbon in the storage area the ribbon is unable to pass over the extensions of the weirs and hence the mass of folded ribbon is retained within the area defined by the weirs and their extensions. It will be appreciated that, unlike a continuous side wall defining a storage area, the weir extensions make contact with the ribbon folds only adjacent the edges of the ribbon and consequently the friction between the ribbon folds and the wir extensions is reduced substantially. As a result the ribbon is more readily drawn from the storage area in the housing and it is possible to contain a longer length of ribbon in the housing while ensuring that the withdrawal force required is maintained at a low level. It should be understood that although the outer wall 12 and an inner wall 13 extend adjacent the storage area, these walls do not engage the ribbon or in any way define the ribbon storage area since the weir extensions ensure that the ribbon is held away from these walls.

As described above the housing is provided with a weir and extensions on the wall 11 and on the cover 15. However if desired only one weir may be provided either on the wall 11 or the cover 15 and the weir extensions may be provided on one or both of the wall 11 and cover 15.

We claim:

1. An inked ribbon cassette including first and second walls spaced apart by a first distance; a ribbon storage region extending between said first and second walls; a length of inked ribbon contained in said ribbon storage region in a plurality of random folds, said ribbon having a width extending substantially perpendicular to said walls; said first distance being slightly in excess of said width of said ribbon; an entry to the storage region for feeding said ribbon into the storage region; an exit located remotely from said entry for withdrawing said ribbon from said storage region; and corresponding opposed first and second ridges projecting from said first and second walls respectively with a space between said first and second ridges; each ridge extending along two sides of the storage region from the entry toward the exit and between the storage region and the exit; said first and second ridges projecting from said first and second walls to an extent such that said space therebetween has a width slightly less than said width of said ribbon, said ridges being operative to retain said ribbon within the storage region and permitting withdrawal of the ribbon from the storage region through the space between the ridges to the exit.

2. An inked ribbon cassette as claimed in claim 1 including first and second side walls extending from said first wall to said second wall and extending from said entry to said exit; said storage region and said first and secod ridges being located between said first and second side walls; and said first and second ridges being operative to prevent engagement between the folded ribbon and said side walls.

3. An inked ribbon cassette as claimed in claim 2 wherein said first and second side walls are integral with and project from said first wall.

4. An inked ribbon cassette including first and second walls spaced apart by a first distance; a ribbon storage region extending between said first and second walls; a length of inked ribbon contained in said storage region in a plurality of random folds, said ribbon having a width extending substantially perpendicular to said walls; an entry adjacent said storage region for feeding said ribbon into said storage region; an exit located remotely from said entry for withdrawing said ribbon from the ribbon storage region; a first ridge projecting from said first wall toward said second wall with a space between said first ridge and said second wall slightly less than said width of the ribbon and said first ridge extending along two sides of said storage region from said entry toward said exit and between said storage region and said exit.

5. An inked ribbon cassette as claimed in claim 4 including first and second side walls projecting from said first wall and extending from said entry to said exit; said storage region and said first ridge being located between said first and second side walls and said first ridge being operative to prevent engagement between the folded ribbon and said side walls.

6. An inked ribbon cassette as claimed in claim 4 including a second ridge projecting from said second wall corresponding and opposed to said first ridge; said first and second ridges projecting to an extent to leave a space therebetween slightly less than said width of the ribbon.

7. An inked ribbon cassette as claimed in claim 6 including first and second side walls projecting from said first wall and extending from said entry to said exit; said storage region and said first and second ridges being located between said first and second side walls and said first and second ridges being operative to prevent engagement between the folded ribbon and said side walls.

* * * * *